US007610780B2

(12) United States Patent
Malaguti

(10) Patent No.: US 7,610,780 B2
(45) Date of Patent: Nov. 3, 2009

(54) FABRIC ARTICLES DRY CLEANING MACHINE BY SOLVENT NEBULIZATION

(75) Inventor: Marino Malaguti, Bologna (IT)

(73) Assignee: I.L. S.A. SpA, Bologna (IT)

( * ) Notice: Subject to any disclaimer, the term of this patent is extended or adjusted under 35 U.S.C. 154(b) by 238 days.

(21) Appl. No.: 11/146,680

(22) Filed: Jun. 7, 2005

(65) Prior Publication Data

US 2006/0248929 A1 Nov. 9, 2006

(30) Foreign Application Priority Data

May 6, 2005 (IT) ..... BO2005A0323

(51) Int. Cl.
*D06B 5/24* (2006.01)

(52) U.S. Cl. ..... 68/18 R; 68/18 F; 68/18 C; 8/159

(58) Field of Classification Search ..... 68/18 R, 68/18 C, 18 F; 134/184, 198
See application file for complete search history.

(56) References Cited

U.S. PATENT DOCUMENTS

| | | | | | |
|---|---|---|---|---|---|
| 3,168,469 | A | * | 2/1965 | Abdalian et. al. | 210/232 |
| 3,401,052 | A | * | 9/1968 | Berger et. al. | 427/242 |
| 3,583,181 | A | * | 6/1971 | Brillet | 68/18 F |
| 3,610,002 | A | * | 10/1971 | Carpigiani | 68/18 C |
| 3,674,650 | A | * | 7/1972 | Fine | 202/176 |
| 3,761,200 | A | | 9/1973 | Gardiner | |
| 3,937,043 | A | * | 2/1976 | Hughes et al. | 68/18 R |
| 4,489,574 | A | * | 12/1984 | Spendel | 68/16 |
| 5,758,377 | A | * | 6/1998 | Cimetta et al. | 8/158 |
| 5,802,884 | A | * | 9/1998 | Cavalli | 68/18 C |
| 5,827,329 | A | | 10/1998 | Champeau | |
| 6,189,891 | B1 | | 2/2001 | Tomita et al. | |
| 6,346,126 | B1 | * | 2/2002 | Chao et al. | 8/149.2 |
| 6,691,536 | B2 | * | 2/2004 | Severns et al. | 68/12.27 |
| 6,793,685 | B2 | * | 9/2004 | Noyes et al. | 8/149.2 |
| 6,862,767 | B2 | * | 3/2005 | Runyon | 8/158 |
| 6,889,399 | B2 | * | 5/2005 | Steiner et al. | 8/159 |
| 6,898,951 | B2 | * | 5/2005 | Severns et al. | 68/5 C |
| 7,021,087 | B2 | * | 4/2006 | France et al. | 68/17 R |
| 7,047,663 | B2 | * | 5/2006 | Zhang et al. | 34/348 |
| 7,059,065 | B2 | * | 6/2006 | Gerlach et al. | 34/381 |
| 7,210,182 | B2 | * | 5/2007 | Fyvie et al. | 8/158 |

FOREIGN PATENT DOCUMENTS

| | | | |
|---|---|---|---|
| DE | 41 12 230 | * | 10/1992 |
| DE | 197 23 537 C2 | | 10/1998 |
| EP | 1 722 026 A2 | | 11/2006 |
| JP | 04-122297 | * | 4/1992 |

* cited by examiner

*Primary Examiner*—Frankie L Stinson
(74) *Attorney, Agent, or Firm*—J. Harold Nissen; Lackenbach Siegel LLP

(57) ABSTRACT

Fabric articles dry cleaning machine by solvent nebulization discloses wherein the cleaning and the dirt removal are based on solvent action nebulized on the surface of the fabric articles without the same articles being soaked and without a full immersion or soaking pre or post nebulization of the same fabric articles.

18 Claims, 3 Drawing Sheets

FABRIC ARTICLES DRY CLEANING MACHINE BY SOLVENT NEBULIZATION

In the field of the dry cleaning machines, the cleaning system of the fabric articles introduced into the cylinder provides, actually, the complete immersion of the fabric articles into the solvent. The fabric articles introduced into the cylinder are completely soaked with solvent on the base of defined quantities, i.e. from three to five liters for each kilograms of fabric articles to be cleaned. The mechanical action actuates to the cylinder rotation permits the complete impregnation of the solvent into the fabric articles to be cleaned by the shaking and the falling down of the fabric articles into the rotating cylinder. In working an average capacity dry cleaning machine needs tanks for be solvent to be used with a capacity of about two hundred liters, so making these machines cumbersome and heavy and with the necessity of rooms with particular characteristics for their localization.

Moreover, before the drying step, is necessary to execute the centrifuge to take away the bigger solvent quantity possible to the fabric articles. For some solvents, in particular the hydrocarbon ones that are currently used for their eco-compatibility characteristics, it is necessary to work with rotation velocity very high owing to the low vapour pressure of these solvents. The solvent introduced into the cylinder and the fabric articles so form a no-homogeneous mass of high weight that is subjected, during the centrifuge, to high angular velocities. This creates the vibrations. The known dry cleaning machines are consequently anchored to the floor and/or equipped with apparatuses to contrast are eliminate said vibrations. On the base of aforesaid, the centrifuge to elimination the solvent from the fabric articles creates economical costs owing to the necessary absorber devices, to the electrical consumption to start the electrical motor connected to the cylinder and a particular choice of the rooms where the dry cleaning machines are placed. An other aspect is connected to the disposal of the big quantity of the used solvents. The solvent used in the cleaning must be depurated into a distiller, by means of the solvent boiling and the subsequent condensation obtained in suitable exchangers inside which flow the cooling water. For the distillation are so necessary, on the base of the used solvent, on an average three or four water liters for each solvent liter. For a machine of average loading the quantity of distilled solvent in one hour, corresponding to two pre-washings, is of about eighty liters.

Figure 1:
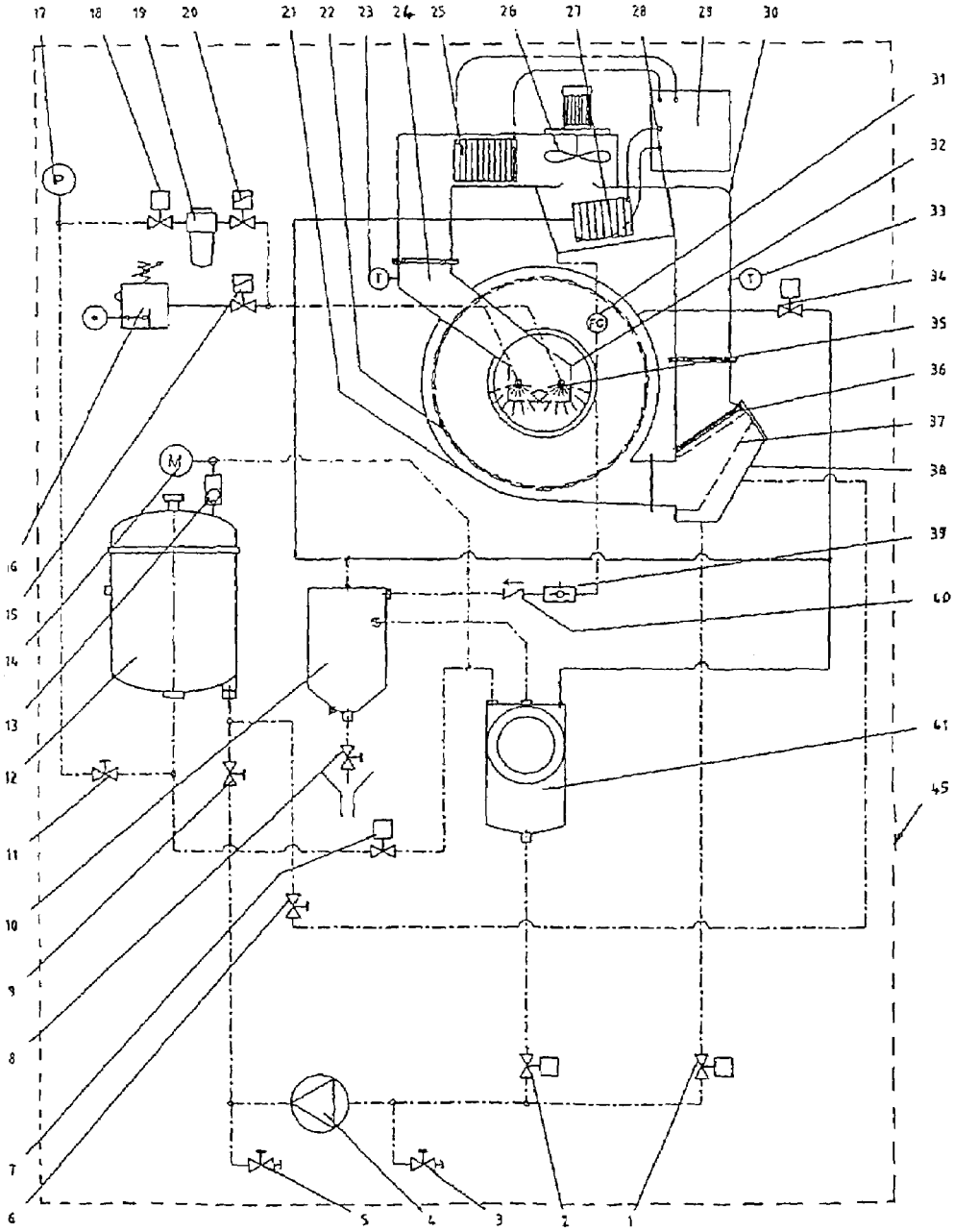
Figure 2:
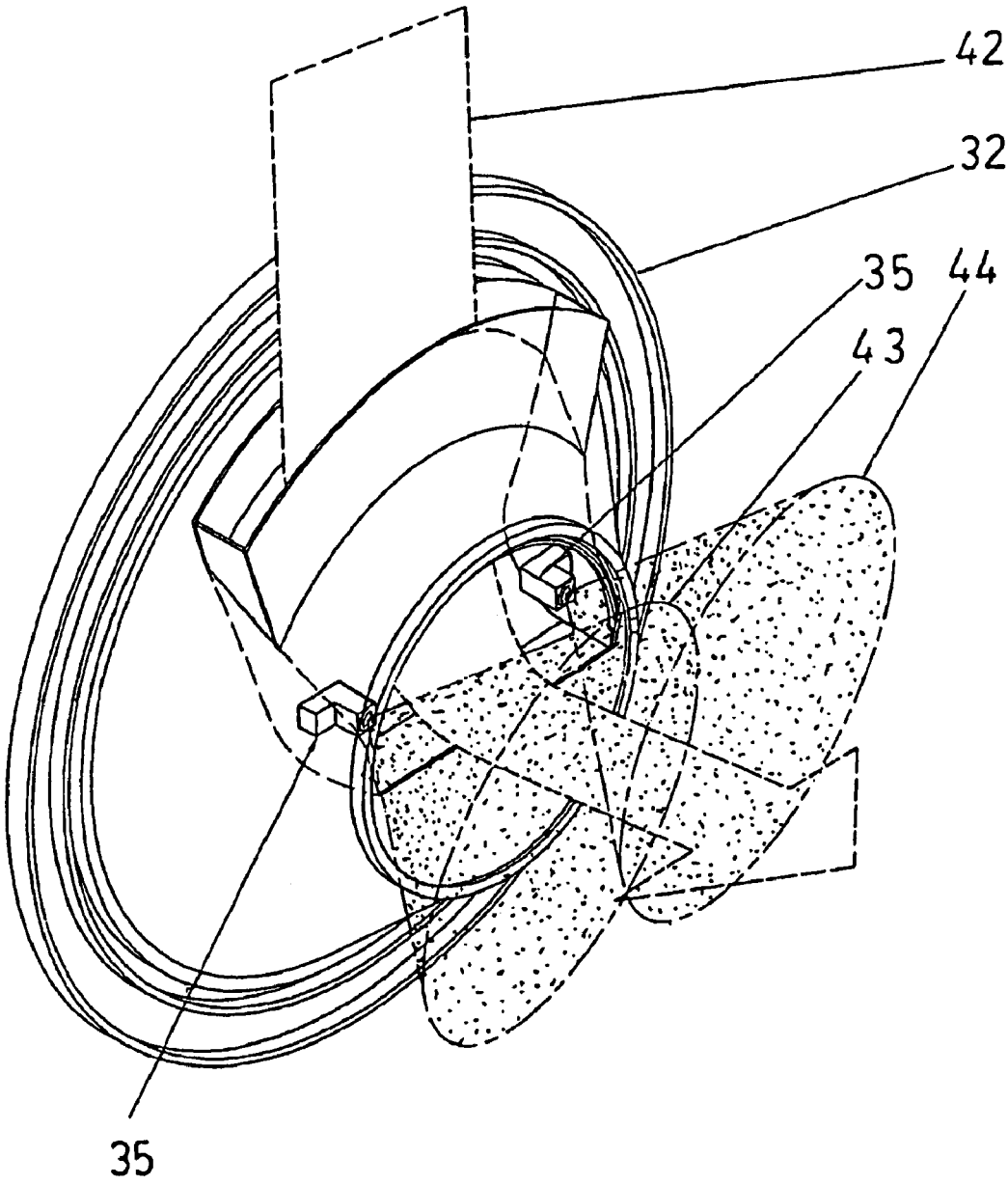
Figure 3:
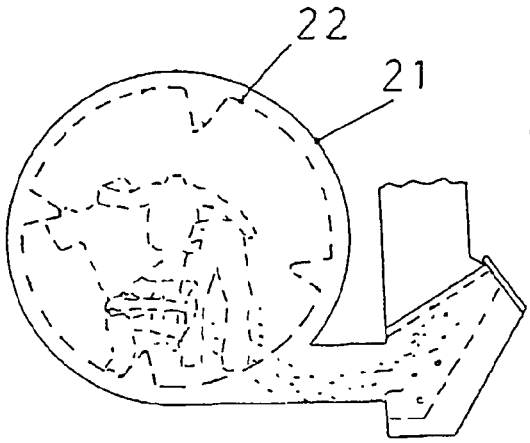
Figure 4:
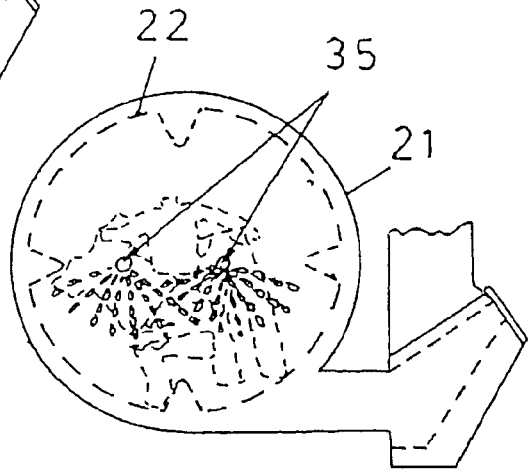
Figure 5:
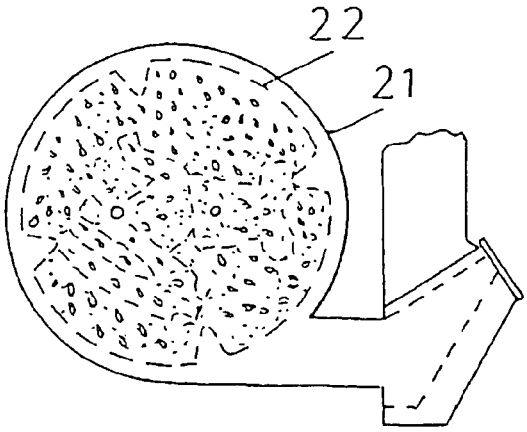
Figure 6:
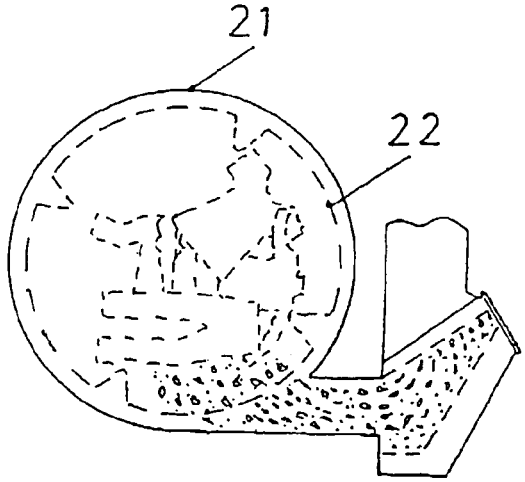

So for the distillation of said solvent there is an average use in a work day of about two cubic meters of water. The produced distillation waste must be disposed on the base of particular rules regulated to the laws of the different states such as they are dangerous waste. This step so determines high disposal costs, essentially caused to the used quantity of solvent for the complete immersion of the fabric articles inside the cylinder. The present invention has the aim to mainly reduce said disadvantages making minimum the solvent use, avoiding the centrifuge to eliminate the solvent from the fabric articles and substantially reducing the water use, the disposals and the energetic use. This and other aims of the present invention will be better understood from the following description and claims together with the enclosed drawings of sheet 1, 2 and 3 in which a preferred embodiment of this invention is shown. In sheet 1 FIG. 1 is diagram of the invented machine. In said diagram the air circuit is drawn in continuous line whereas the pipes of the circuit of the solvent are drawn with line and point. In sheet 2 FIG. 2 is view of a door with air conveyor equipped with nozzles for the solvent nebulization. In sheet 3 FIGS. 3, 4, 5 and 6 show, in a merely indicative way, the main phases of clearing obtained with the invented machine. The invented machine is essentially based onto a nebulization system of the solvent onto the fabric articles inside the cylinder of the dry cleaning machines and it does not provide the full immersion of the fabric articles to be cleaned nor the centrifuge. The nebulization is essentially obtained by means of one or more nozzles. These nozzles distribute the solvent in very small drops directly onto the fabric articles to be worked into the cylinder, both still that in rotation, with contemporary intake of cold or warm air inside the same cylinder. The nebulization permits a cutting down of the used solvent in comparison with the known dry cleaning machines created with cycles based on the complete immersion of the fabric articles in the solvent inside the cylinder. Consequently, the smaller use of solvent permits also a considerable cutting down of the disposal costs of the same solvent. Also the centrifuge is to be unnecessary and so it is not used in the invented dry cleaning machines, with the eliminations of all the problems due to the vibrations. Moreover, the smaller use of solvent permits the changing of the distillation apparatuses used in the known dry cleaning machines with more easy fluid filtration systems, through a paper-activated carbon filtering clement, directly onto the getting circuit of the solvent. Then there is a big cut of the tanks that requires a capacity of about twenty/twenty-five liters, with reduction of the volume and of the total weight of the dry cleaning machines, Then, it is to be considered that in the known dry cleaning machine the solvent loaded of residuals and of dirtiness is piped in the distillation apparatuses where, by means of boiling, evaporation, condensation and recovery presses is separated and depurated from the residuals and from the dirtiness in its inside.

Said residuals in form of sludge with average of solvent in their inside, being dangerous waste, determine high costs of disposal. The invented machine instead acts the removal of the dirty in four different phases where, in the fist phase, it is provided the air intake through the article fabrics still not treat with the solvent.

In this way the superficial maro-impurities are removed, such as hairs, down, dust and other parts of this dimension that, through the intake duct, are stored into the button trap 37 and onto the surface of the air filter 36. To follow a second step where the solvent is nebulized onto the article fabrics to treat, by the nozzles 35, with the cylinder 22 in rotation inside the housing 21. The mechanical action actuated to the rotation of the cylinder 22 determines an uniform distribution of the solvent that begins to actuate its cleaning action. The third step consists of the nebulization of the solvent into the article fabrics to be treated inside the cylinder 22 in rotation and the contemporary intake of hot air. In this way the cleaning action of the solvent onto the article fabrics is actuated, strengthened to the mechanical action of the cylinder rotation and contemporary the introduced air provides to the transport out to the cylinder 22 of the solvent drops with the melted dirty through the suction duct 38. Part of this dirty solvent is kept in the filtering systems present inside the said duct and the remaining part is piped toward an evaporation coil 27 where Freon in expansion flows at a temperature to 0° C. till −5° C. The solvent drops are condensing and they are recovered into the separator 10 then coming to the tank 41. The fourth step is the drying phase. Also in this step the removing of dirt from the article fabrics goes on such as are present the same conditions of the third step with only the exclusion of the solvent nebulization. Going on with the article fabrics warning up, by means of hot air, the solvent contained in them evaporated and it is transported to the circulating air through the apparatuses that actuate the complete condensation and the collecting.

The dirty solvent, that during the previous phases was collected onto the bottom of the suction duct, is sucked by the pump 4 and it is put in circulation through the solvent-filter before to arrive to the tank 41. The machine is placed onto a containment tank 45 that, other to support the different components, has also the aim to avoid solvent dispersions on the floor in case of losses or anomalies. The barrel 21 is fixed to a frame and it contains the cylinder 22 to which are connected the apparatuses for its rotation. To said barrel 21 are connected the suction duct 38 and the drying duct 30 fixed by means of sealed flanges. Inside the suction duct are present the button trap 37 and the air filter 36 for keeping the impurities and the threads loss to the article fabrics. The drying duct 30 has, in its inside, other to a second safety air filter, an evaporation coil 27, having the aim of condensation and recovery of the solvent and a Freon condensation coil 25 where compressed Freon flows with a temperature of 70°-80° C. having the aim to give the heat for the drying, collecting also the heat otherwise loss to the refrigerating apparatus 29. An impeller 26 linked to an electric engine determines the air circulation inside the sealed circuit tank-button trap-air circuit. The refrigerator apparatus 29 consists of a compressor, a capacitor and the necessary components for the Freon circulation inside the exchangers to which is connected. The dry cleaning machine has the front door 32 equipped with a patented air conveyor for the drying, said air coming to the upper forced air inlet 42. Onto said door 32 are fixed the spray nozzles 35 connected to the solvent circuit. Moreover, the machine have a tank 41 of about twenty liters of capacity, a separator 10 to separated the water eventfully present in the recuperated during the drying phase, a paper-activated carbon cartridge filter 12 for the circulated solvent depuration and a pump 4 for the circulation of the solvent during the cleaning phases. The plant includes also fittings such as a loading manual valve 3, a manual discharge-valve 5, a manual valve 6 for filter discharge, a valve 8 for separator emptying, a stop valve 9 for the filter inlet, a stop manual valve 11 for the filter outlet, an air valve 13 for the filter exhaust, a valve 34 for air-balance and a check valve 40. Moreover other addition components are provided for the machine working such as a filter pressure gauge 14, a regulator 16 of the air for the nozzles cleaning, a manometer 17, a filter 19 for the nozzles, a drying air thermostatic switch 23, a sight-glass 31 for solvent passing and a drying air thermostatic switch 33 present onto the outlet of the barrel 21. All the working steps are driven by a P.L.C. that controls the different steps and their duration. In working, the invented dry cleaning machine, after to have put the fabric articles into the cylinder and to have closed the door, is started by the operator for the cleaning cycle. The cleaning program starts with a short time of primer of the pump 4, by opening of he valves 2 and 7, with rotation starting of the cylinder 22 and the starting of the refrigerator apparatus 29 and of the impeller 26. The solvent sucked from the tank, circulated though the filter 12 and it returns to the tank whereas the air begins to circulate between the drying duct 30, the air inlet 24, the barrel 21 and the suction duct 38. The following step provides the only air circulation and the cylinder rotation, whereas the valves 2 and 7 are closed and the pump stops. In this step a pre-heating of the cylinder and of the fabric articles is provided before the cleaning phase. At the end of this step the refrigerator apparatus and the impeller are stopped and the cleaning phases of the fabric articles begin. With the cylinder in rotation the valves 2, 18 and 20 are opened and the pump 4 is started. The solvent is sucked from the tank 41 and, through the filter 12, is sent to the spray nozzles 35. In this step, named as "static nebulization", a first solvent quantity is nebulized onto the fabric articles without a forced air flow. Then there is a short step in where only the rotation of the cylinder is actuated with disarming of the valves and of the pump to create a mechanical action of removal of the dirty to the fabric articles. The cleaning cycle goes on with the "dynamic nebulization" where the solvent is nebulized with a forced air flow and where the valves 2, 18 and 20 are opened and the refrigerator apparatus 29 and the impeller 26 are started. The solvent is sucked from the tank 41 and, through the filter 12, comes to the spray nozzles 35 that give out nebulized drops 43 and 44 whereas the air circulating through the inlet 24 transports the nebulization in uniform way into the fabric articles in rotation. The air action into the cylinder is helped by the upper inlet placed in the inside part of the door 32. Following the solvent is discharged from the barrel: with the cylinder in rotation and started the refrigerator apparatus and the ventilation, the valves 2, 18 and 20 are closed and the valves 1 and 7 are opened. The solvent is sucked from the suction duct 38 and through the filter 12 is put again into the tank 41.

Before the drying step the cleaning of the spray nozzles and of their pipes is actuated by opening the valve 15 that inlets compressed air into the injection duct.

This avoids that the residual solvent drops stain the fabric articles during the drying step. In said step, of variable duration defined to the automatic device 39 of drying control, heating air is put in circulation though the fabric articles and the solvent in them contained is condensed in the evaporation coil 27 and recovered into the separator 10 where the water, eventually present, is separated to the solvent that is sent to the tank 41. During the drying step intermediate discharge of the solvent eventually present on the bottom of the tank are actuated. At the drying end the cooling is actuated where air in circulation through the fabric articles in rotation, with the exchanger 24 not in function but with the exchanger 25 in working. In this way, the not heating air, passing through the cooling exchanger is more cooled and the eventual residual solvent is recuperated. The cleaning cycle is so stopped. The enclosed drawings will be better understood from the following list of components:

1=barrel suction valve
2=tank suction valve
3=loading manual valve
4=pump
5=manual discharge valve
6=manual valve for filter discharge
7=return tank valve
8=valve for separator emptying
9=manual stop valve for filter inlet
10=separator
11=stop manual valve for the filter outlet
12=paper-activated carbon cartridge filter
13=air valve for the filter exhaust
14=filter pressure gauge
15=valve for nozzles cleaning
16=regulator of the air for the nozzles cleaning
17=manometer
18=barrel inlet valve
19=filter for the nozzles
20=valve inlet nozzles
21=barrel
22=cylinder
23=drying air thermostatic switch
24=air inlet
25=Freon condensation coil
26=impeller
27=Freon evaporation coil
28=safety air filter

29=refrigerator apparatus
30=drying duct
31=sight-glass
32=front door
33=drying air thermostatic switch
34=valve for the air-balance
35=nozzles
36=air filter
37=button trap
38=suction duct
39=automatic device of drying control
40=check valve
41=tank
42=forced air inlet duct
43=solvent nebulized drops
44=solvent nebulized drops
45=containment tank

The invention claimed is:

1. A dry cleaning machine including the use of solvent nebulization for dry cleaning textile fabric articles, consisting of:

a cleaning chamber, and means associated with said cleaning chamber including a rotatable cylinder (22) in which the fabric articles are contained and means to drive the cylinder in a rotatory motion, a clear liquid solvent and at least one nozzle (35) through which said clear liquid solvent is nebulized and with means for supplying hot or cold air circulating within a sealed air circuit and conveyed into the cylinder, for cleaning and removal of dirt and solvent based on the solvent action of the nebulized solvent drops which are uniformly distributed directly onto the entire surfaces of the textile fabric articles by means of a contemporary intake of the air flow circulation through the forced air inlet duct (42) and then the dirt and nebulized solvent drops are moved directly through a suction duct (38) out of the cleaning chamber and piped again in the sealed air circuit system for the regeneration of the solvent used for the cleaning action and the recovery of dissolved and non-dissolved dirt retained by the solvent drops transported by the air flow and a circuit consisting of a valve for nozzle cleaning (15) and a regulator (16) for regulating the air flow of air to said at least one nozzle for cleaning of said at least one nozzle to prevent residual nebulized drops from staining the fabric articles during the drying phase.

2. The dry cleaning machine according to claim 1, including drying means comprising hot air intake for removing solvent from the fabric articles and for actuating means for condensation and collection of the solvent inside a recovering and filtering apparatus without a centrifuge for a complete condensation and collection of the solvent and without an intermediate-centrifugation phase and without high speed rotation of a rotatable cylinder (22).

3. The dry cleaning according to claim 1, including a separator (10) for recovering solvent drops which are contained therein and to separate water during the drying phase and a disposable paper/clay cartridge filter (12) provided for solvent depuration thereby avoiding the necessity of distillers and for removing the dirt from the fabric articles and the cleaning of the solvent without any distillation system.

4. The dry cleaning machine according to claim 1, including a separator (10) for separating water during the drying phase and a disposable paper/clay cartridge filter (12) provided for circulated solvent depuration thereby avoiding the necessity of distillers, and a button trap filter (37) and an air filter (36) which is placed at the outlet of said cleaning chamber for catching part of the dirt not completely soluble prior in said solvent in said separator (10).

5. The dry cleaning machine for dry cleaning textile fabric articles according to claim 1, including a refrigeration apparatus (29) and heat exchangers (25-27) operating in the sealed air circuit system, with total exclusion of any additional heaters for the warming of the contained closed circulating air.

6. The dry cleaning machine for dry cleaning textile fabric articles according to claim 1, including a control for operating a complete washing drying cycle with a rotation speed of the cylinder (22) below 1G and without an intermediate extraction-centrifugation phase to provide rotation without high-speed rotation of the cylinder (22).

7. A method of cleaning textile fabric articles using a dry cleaning machine as claimed in claim 1 employing solvent nebulization comprising the steps of:

passing air through the textile fabric articles to be cleaned for removing hairs, dust and insoluble dirt and storing them in a trap and onto the surface of an air filter;

distributing nebulized solvent drops through nozzles onto the textile fabric articles while in a rotatable chamber which is rotated to provide for a perfunctory distribution of the solvent into the textile fabric articles for cleaning thereof;

nebulizing the solvent into the cleaning chamber together with the contemporary intake of air through a forced inlet duct for an uniform distribution of the nebulized solvent drops on the entire surface of the textile fabric articles;

strengthening the cleaning action of the solvent while the chamber is rotated; and removing the solvent with melted dirt and soluble dirt from the textile fabric articles and further lubricated un-melted dirt from the fabric pores and textile weaves through a suction duct and piping any residual dirt through the suction duct.

8. The method according to claim 7 including:

condensing the solvent drops with melted dirt in a heat exchanger.

9. The method according to claim 7, including:

subjecting the textile fabric articles to warm air for drying the fabric articles and for evaporating any solvent contained in the textile fabric articles and transporting the melted and un-melted dirt in the solvent drops and in air stream by means of the circulating air.

10. The method according to claim 7, including cleaning of the nozzles through which the nebulized drops are supplied to prevent nebulized drops from staining the fabric articles.

11. A dry cleaning machine including the use of solvent nebulization for drycleaning textile articles, consisting of:

a cleaning chamber, and means associated with said cleaning chamber including a rotatable cylinder (22) in which the fabric articles are contained and means to drive the cylinder in a rotatory motion, a clear liquid solvent and at least one nozzle (35) through which said clear liquid solvent is nebulized and with means for supplying hot or cold air circulating within a sealed air circuit and conveyed into the cylinder, for cleaning and removal of dirt and solvent based on the solvent action of the nebulized solvent drops which are uniformly distributed directly onto the entire surfaces of the textile fabric articles by means of a contemporary intake of the air flow circulation through the forced air inlet duct (42) and then the dirt and nebulized solvent drops are moved directly through a suction duct (38) out of the cleaning chamber and piped again in the sealed air circuit system for the regeneration of the solvent used for the cleaning action and the recovery of dissolved and non-dissolved dirt retained by the solvent drops transported by the air flow; and a circuit for the cleaning of said at least one nozzle to provide an exclusive circuit in combination with a uniform distribution of the solvent and to prevent residual nebulized drops from staining the fabric articles during the drying phase.

12. A dry cleaning machine for dry cleaning textile fabric articles by solvent nebulization comprising:

means including a closed and sealed air circulation system for recirculating air comprising sealed drying-duct (30) associated with a door (32), equipped with a forced air inlet duct (42), an air inlet duct (24), a suction duct (38), a treatment chamber (21) in the form of a barrel including a cylinder (22) for receiving the textile fabric articles to be cleaned and means to drive said cylinder (22) in a rotary motion, an impeller (26), heat exchange coils (25, 27, a refrigerator apparatus (29);

a clear-liquid-solvent and at least one or more nozzles (35) through which said liquid solvent is nebulized to obtain solvent nebulized drops (44) so that dirt which is on the surface of the textile fabric articles and in openings or pores of the textile fabric articles is dissolved and/or broken loose is retained and encapsulated by the small drops of solvent which are transported by the air flowing through the closed air circulating system outside of the treatment chamber (21) for removal of the dirt from the openings, pores and surface of the textile fabric articles and condensing the nebulized solvent drops containing melted dirt in a heat exchanger inside of the sealed drying duct (30) connected to the treatment chamber and recovering the condensed solvent drops in a separator; and comprising the step of using said solvent nebulization and including a circuit for the cleaning of nozzles to prevent nebulized solvent drops from staining the textile fabric articles.

13. The dry cleaning machine for dry cleaning textile fabric articles according to claim 12, including means to provide cold or hot air for the closed and sealed air circulating system.

14. A dry cleaning machine including the use of solvent nebulization for dry cleaning textile fabric articles consisting of:

a cleaning chamber, and means associated with said cleaning chamber including a rotatable cylinder (22) in which the fabric articles are contained and means to drive the cylinder in a rotatory motion, a clear liquid solvent and at least one nozzle (35) through which said clear liquid solvent is nebulized and with means for supplying hot or cold air circulating within a sealed air circuit and conveyed into the cylinder, for cleaning and removal of dirt and solvent based on the solvent action of the nebulized solvent drops which are uniformly distributed directly onto the entire surfaces of the textile fabric articles by means of a contemporary intake of the air flow circulation through the forced air inlet duct (42) and then the dirt and nebulized solvent drops are moved directly through a suction duct (38) out of the cleaning chamber and piped again in the sealed air circuit system for the regeneration of the solvent used for the cleaning action and the recovery of dissolved and non-dissolved dirt retained by the solvent drops transported by the air flow, and wherein the dry cleaning machine is free of any distilled apparatus for cleaning and regeneration of the liquid solvent by providing a new washing process for separating non-soluble dirt from soluble dirt in different phases with an air intake being provided to remove hairs, dust and other dirt through a forced air intake duct (42) and including a button trap (37) for storing the removed hairs, dust and other dirt in said button trap (37), then nebulizing the liquid solvent through said at least one nozzle (35) and while said cylinder (22) is rotating the solvent is nebulized to produce small drops together with a contemporary intake of hot air through the forced air inlet duct (42) for a uniform distribution of the nebulized solvent onto the fabric articles and such flow of the hot air provides for the transportation out from the treatment chamber solvent drops containing melted dirt by the hot air and which passes through the suction duct (38) where part of the non-soluble dirt is retained in filtering apparatuses (36)(37), the soluble dirt is then condensed in a heat exchanger (27) and recovered in a separator (10) and then the soluble dirt enters into a containment tank (45) from which the solvent is passed by a pump (4) through a clay or paper carbon cartridge filter (12) for removing any remaining part of the soluble dirt which is non-soluble dirt during the cleaning and drying process.

15. The fabric articles dry cleaning machine using solvent nebulization, according to claim 14, including a circuit for the cleaning of said nozzles to provide an exclusive circuit in combination with the uniform distribution of the solvent and to prevent excess residual or remaining novel drops from staining the fabric articles during the drying phase.

16. A dry cleaning machine including the use of solvent nebulization for dry cleaning textile fabric articles, consisting of:

a cleaning chamber, and means associated with said cleaning chamber including a rotatable cylinder (22) in which the fabric articles are contained and means to drive the cylinder in a rotatory motion, a clear liquid solvent and at least one nozzle (35) through which said clear liquid solvent is nebulized and with means for supplying hot or cold air circulating within a sealed air circuit and conveyed into the cylinder, for cleaning and removal of dirt and solvent based on the solvent action of the nebulized solvent drops which are uniformly distributed directly onto the entire surfaces of the textile fabric articles by means of a contemporary intake of the air flow circulation through the forced air inlet duct (42) and then the dirt and nebulized solvent drops are moved directly through a suction duct (38) out of the cleaning chamber and piped again in the sealed air circuit system for the regeneration of the solvent used for the cleaning action and the recovery of dissolved and non-dissolved dirt retained by the solvent drops transported by the air flow; and drying means for carrying out the drying phase consisting of a sealed drying duct (30), an impeller (26) and a refrigerator apparatus (29) connected with an heat exchanger (25) in which the hot compressed refrigerator gas is circulating, to provide for the necessary heat for the drying phase, and connected to the heat exchanger (27) in which the cold expanded refrigerator gas is circulating, for condensing and recovering the solvent during the drying phase.

17. The method according to claim 16, including:

subjecting the textile fabric articles to warm air for drying the fabric articles and for evaporating any solvent contained in the textile fabric articles and transporting the melted and un-melted dirt in the solvent drops and in air stream by means of the circulating air.

18. A dry cleaning machine including the use of solvent nebulization for dry cleaning textile fabric articles, consisting of:

a cleaning chamber, and means associated with said cleaning chamber including a rotatable cylinder (22) in which the fabric articles are contained and means to drive the cylinder in a rotatory motion, a clear liquid solvent and at least one nozzle (35) through which said clear liquid solvent is nebulized and with means for supplying hot or cold air circulating within a sealed air circuit and conveyed into the cylinder, for cleaning and removal of dirt and solvent based on the solvent action of the nebulized solvent drops which are uniformly distributed directly onto the entire surfaces of the textile fabric articles by means of a contemporary intake of the air flow circulation through the forced air inlet duct (42) and then the dirt and nebulized solvent drops are moved directly through a suction duct (38) out of the cleaning chamber and piped again in the sealed air circuit system for the regeneration of the solvent used for the cleaning action and the recovery of dissolved and non-dissolved retained by the solvent drops transported by the air flow; and a control for controlling operation of a complete washing-drying cycle without an intermediate extraction-centrifugation phase during rotation of the rotatable cylinder (22) to provide rotation of the cylinder without high-speed rotation of the cylinder (22).

* * * * *